United States Patent [19]

Messina

[11] 4,248,422

[45] Feb. 3, 1981

[54] ELECTRONIC MAZE GAME

[76] Inventor: Gene Messina, 12 Buccaneer La., E. Setauket, N.Y. 11733

[21] Appl. No.: 35,726

[22] Filed: May 3, 1979

Related U.S. Application Data

[63] Continuation-in-part of Ser. No. 861,847, Dec. 19, 1977, Pat. No. 4,175,743.

[51] Int. Cl.[3] ..... A63F 9/14

[52] U.S. Cl. ..... 273/1 E; 273/1 M; 434/236

[58] Field of Search ..... 273/1 E, 1 M, 1 R, 85 H; 35/22 R, 11 R; 46/236

[56] References Cited

U.S. PATENT DOCUMENTS

| | | | |
|---|---|---|---|
| 1,987,695 | 1/1935 | McDonald | 273/1 R UX |
| 2,265,598 | 12/1941 | Firestone et al. | 273/1 E |
| 2,943,855 | 7/1960 | Jayna et al. | 273/1 E |
| 3,029,526 | 4/1962 | Olalainty | 273/1 E UX |
| 3,208,747 | 9/1965 | Kavakos | 273/1 E |
| 3,406,970 | 10/1968 | Webb, Jr. | 273/85 H |
| 3,466,034 | 9/1969 | Sargent | 273/1 R |
| 3,562,927 | 2/1971 | Moskowitz | 35/22 R |
| 3,913,909 | 10/1975 | Bissell | 273/1 E |
| 3,943,629 | 3/1976 | Ueno et al. | 273/1 E X |

FOREIGN PATENT DOCUMENTS

| | | | |
|---|---|---|---|
| 649908 | 10/1962 | Canada | 273/1 E |
| 966229 | 3/1950 | France | 273/1 E |
| 1180737 | 2/1970 | United Kingdom | 273/1 E |

*Primary Examiner*—Paul E. Shapiro
*Attorney, Agent, or Firm*—Kevin Redmond

[57] ABSTRACT

A maze, having two conductors, on each side of the maze path, is traversed by a conductive wand controlled by the operator. The maze is covered from view by a magnetically attractive surface which also may be made opaque. The wand includes a magnet that rests on the magnetically attractive surface to support the wand, while the wand tip engages the maze path. The path is viewed by way of a mirror increasing the skill required to negotiate the wand tip through the maze path.

8 Claims, 6 Drawing Figures

ELECTRONIC MAZE GAME

This application is a continuation in part of my application entitled "Electronic Game", Ser. No. 861,847 filed on Dec. 12, 1977, now U.S. Pat. No. 4,175,743 issued Nov. 27, 1979.

BACKGROUND

1. Field

This invention pertains to electronic games and more particularly electronic games involving a maze.

2. Prior Art

A number of games include an electronic maze, an alarm or a display, such as the games described in U.S. Pat. Nos. 3,913,909, 3,645,529, 3,488,053, 2,943,855 and 2,808,263. However, once skill has been gained with a particular maze, the challenge is lost and interest wanes with continued use. Although a more difficult maze would make the game more interesting for an experienced player, it would tend to cause the beginner to lose interest because of early and possibly repeated failure. There is no simple way in any of the above mentioned patents to accommodate the novice and experienced player, nor is there any means to increase the difficulty of the game to provide for continued interest.

SUMMARY

In one embodiment, the present invention is a game essentially comprising a maze path or track of two conductors, a conductive wand, a mirror for viewing the maze and a counter for indicating the number of times the wand tip touches the conductor. The player draws the wand along within the maze path and the counter records the number of errors occurring when the player touches either of the conductors with the wand tip. A variety of environmental layouts with cutouts corresponding to the maze path may be placed over the path to increase the interest. For beginners, the game is played by viewing the maze path directly. For more experienced players, the game is made more difficult by requiring the players to observe the track indirectly by means of the mirror.

In a second embodiment, each side of the maze path contains two conductors. A conductive wand tip serves to make contact between the conductors each time it touches the side of the maze path. Direct viewing of the maze is prevented by a magnetically attractive surface. The wand handle contains a magnet which rests on this surface to support the wand, as the wand tip is guided through the maze path by the operator.

An object of the invention is to provide portable amusement.

A second object is to develop skill in precise eye-hand coordination where a device controlled by hand may be viewed directly or indirectly by way of a mirror.

A third object is to test the ability to concentrate while carrying out visually controlled motor tasks under stress created by task time limits and alarms, such as a buzzer or flashing light, which are actuated when an error in control occurs.

A fourth object is to provide a means for improving and measuring manual dexterity for the therapeutic and diagnostic purposes as in the treatment and test of motor skills requiring varying degrees of fine manipulation.

A fifth object is to detect learning disabilities, such as those evidenced by difficulty with the concept of reverse images or impaired eye and hand coordination.

DETAILED DESCRIPTION OF THE INVENTION

Figure 1:
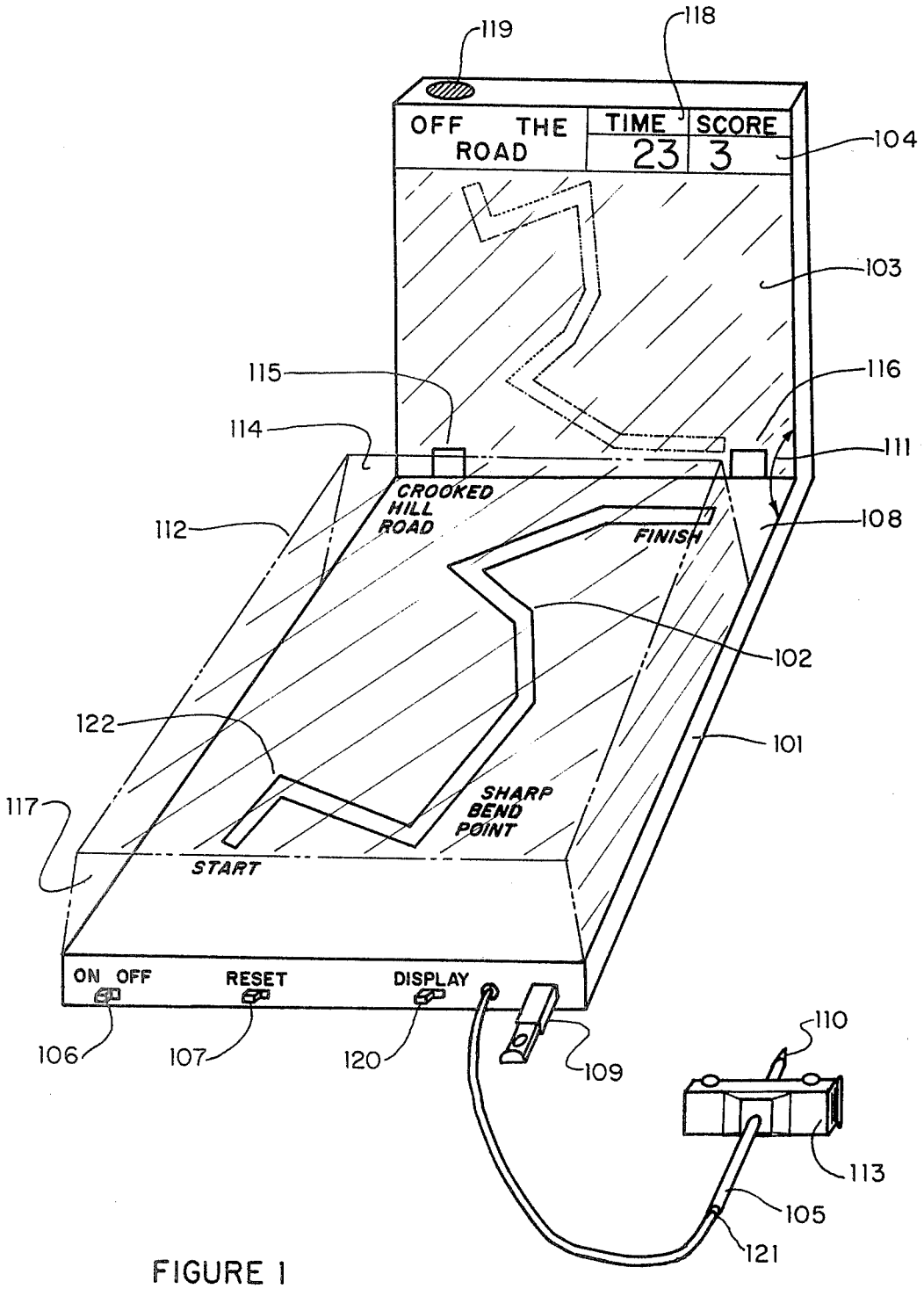
FIG. 1 is a pictorial view of a first embodiment of the game.

Referring to FIG. 1, the game 101 comprises a maze path 102 made of two closely spaced parallel conductive lines, an environmental layout board 108 with a cutout 122 which corresponds to the shape of the maze path, a wand 105 with a handle 121, a tip 110 and a model 113, a reflective surface 103 oriented at an angle 111 with respect to the layout board to present an indirect view of the board to the player, a cover 112 for the layout board with an opening at one end 117 for use by the player, and another opening 114 at the opposite end to provide for indirect viewing of the board by way of the reflecting surface or mirror 103, a polarized light source 115, a nonpolarized light source 116, a counter and counter display 104, a timer and timer indicator 118, an audible and visual alarm 119, an on-off switch 106, a coin insertion device 109, and a display alarm selection switch 120.

In preparing the game, a particular environmental layout board and corresponding model are chosen, such as a roadway through the countryside and a sports car. For the beginner, the cover 112, if opaque, is removed for direct observation of the maze path. The environmental layout board is then set in place over the maze path. The on-off switch is placed in the "on" position or alternatively, where coin operation is desired, a coin is placed in the coin acceptance device and inserted to actuate the on-off switch and supply power to maze, wand, and displays.

In the operation of the game, the player traverses the maze path with the wand tip held between the conductors. The wand tip is nominally one-sixteenth of an inch in diameter while the maze conductors are closely spaced at nominally three-eighths of an inch, leaving a clearance on either side of the wand tip of only five-thirty seconds of an inch. With such close spacings, the player must exercise care and concentration in order to traverse the maze without contacting either maze conductor. Failure to do so will cause the displays to indicate an error.

A different indication of the error is presented, depending on the particular display which is chosen by positioning the selector switch. In the counter position, each error will be counted and displayed as digits on the counter display. In the audible and visual alarm position, a buzzer will sound and a light will flash each time an error is made.

Many variations of the basic game, which remain within the spirit and scope of the invention, are possible. For example, if a sports car is chosen as the model and country road is chosen for the layout board, the alarm may be a siren to simulate a police car siren and the flashing light may illuminate a sign warning "OFF THE ROAD", "YOU JUST RECEIVED A TICKET", or the like. If the layout board simulates a mine field, the model may be a tank and the alarm sound may simulate an explosion.

Other variations include changing the maze path and corresponding layout boards or varying the spacing between the wand and the maze conductors to vary the difficulty of the game.

The maze path conductors are changed by removing them from sockets provided at each end of the conductors. The spacing between the tip and conductors is changed in two ways. The conductors may be plugged into sockets which provide different spacing or wand tips of different thicknesses may be employed.

Games have been found to be interesting when they provide variety and a slight challenge which can be met and overcome. Varying the layout, model, alarm and display provide one aspect of variety. Varying the conductor spacing provides another aspect of variety and allows adjustment of the challenge to keep the game interesting as the players skill increases.

The greatest contribution in the present invention to both variety and challenge is provided by the use of the cover and mirror. The mirror causes the player to view his actions in reverse and requires him to exhibit a high degree of coordination and skill, not generally found in other activities or games.

The game is shown in FIG. 1 with a translucent cover which is only one method contemplated to employ indirect viewing by way of the mirror. Several other variations of the cover may be employed. The simplest is an opaque cover which may be put in place or removed, as desired. The translucent cover may take several forms. The simplest of these includes an additional cover of flexible, opaque material, such as a vinyl sheet which is applied when indirect viewing is desired. In another variation of the translucent cover, the material may be made only partially translucent so that a bright light is required to illuminate the board for direct viewing. Switching to a low intensity light makes the cover essentially opaque; however, with the proper low intensity light, there will be sufficient illumination for indirect viewing by means of the mirror. Lights 115 and 116, shown in FIG. 1, may be used for the low and high intensity lamps.

Finally, the cover may be, in effect, a polarized filter. Light with the correct polarization from one source, such as light 116, will permit direct viewing while a source supplying cross polarized light, such as light 115, will make viewing possible only by means of the mirror.

To achieve the features described above, the game may be configured in a number of ways. A preferred embodiment is shown in FIG. 2.

Figure 2:
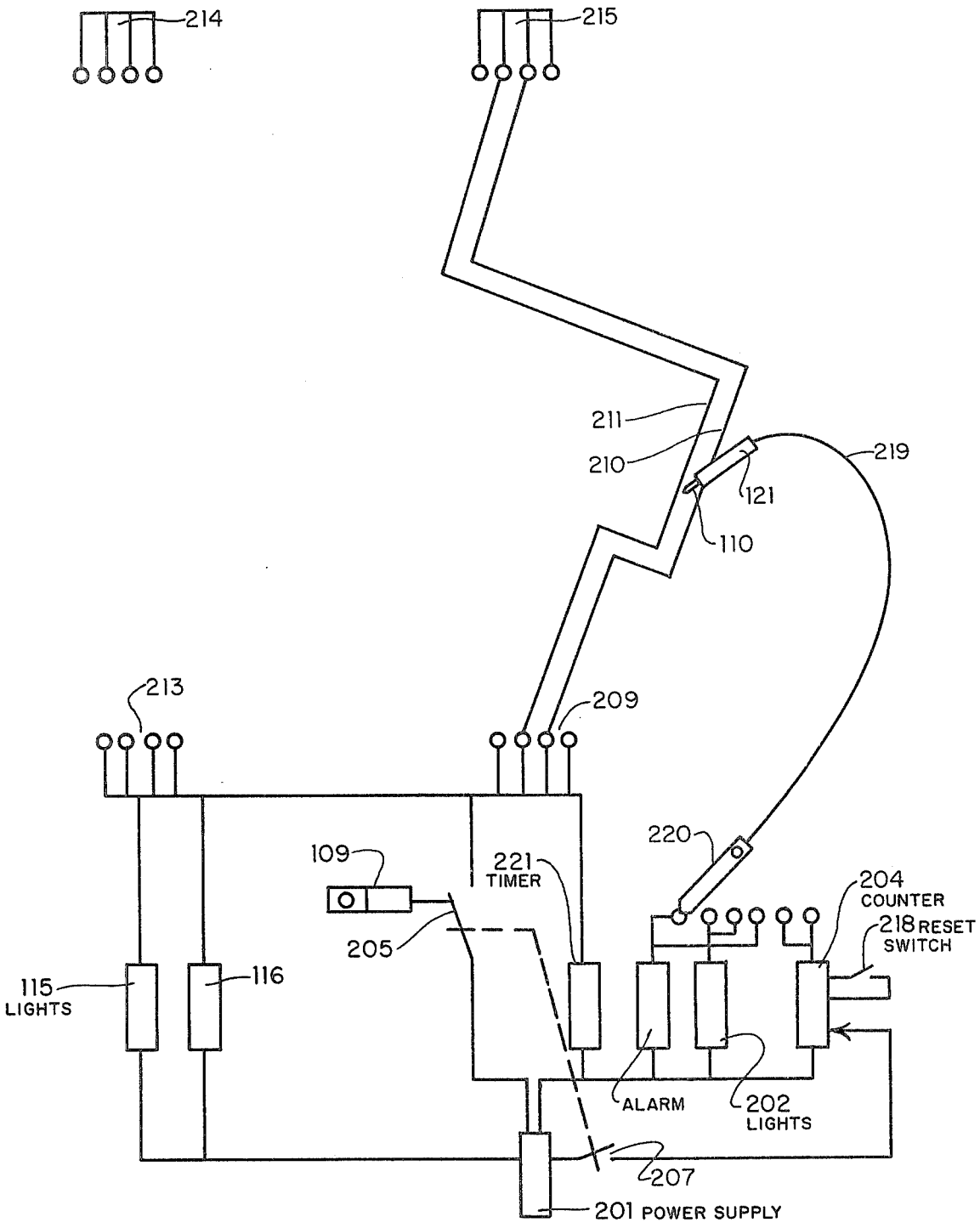
FIG. 2 is a schematic diagram of the game.

The embodiment in FIG. 2 comprises a power supply 201, a light 202, and alarm 203, a counter 204, an on-off switch 205, a coin insertion device 109 to control the on-off switch, a counter supply line 208, a counter supply switch 207, a first set of sockets 209 for the maze path conductors 210 and 211, a second, third and fourth set of sockets designated by drawing numerals 213, 214, and 215 respectively, a wand 121 with a wand tip 110, a wand conductor line 219, a display selector switch 220, a timer 221 and the lights 115 and 116.

In the operation of the system shown in FIG. 2, the on-off switch 205 is closed directly by hand or indirectly by means of the coin insertion device 109. The on-off switch is ganged to the counter supply switch so that the closing the on-off switch also closes the counter supply switch. It is also ganged to the timer so that after a predetermined time, the game is automatically turned off. Closing the on-off switch supplies power to the lights 115 and 116, the jacks 213 and 209. Jack 209 in turn, supplies power to the maze path conductors 211 and 210.

Whenever the wand tip touches either of the maze path conductors, power is supplied to the display selector switch 220 by way of the wand conductor line 219. Power from the selector switch is supplied to the alarm, light 202, or counter, depending on the position of the switch 220.

In this way each contact between the tip and the maze path conductors actuates either the light, alarm or counter or all three.

Figure 3:
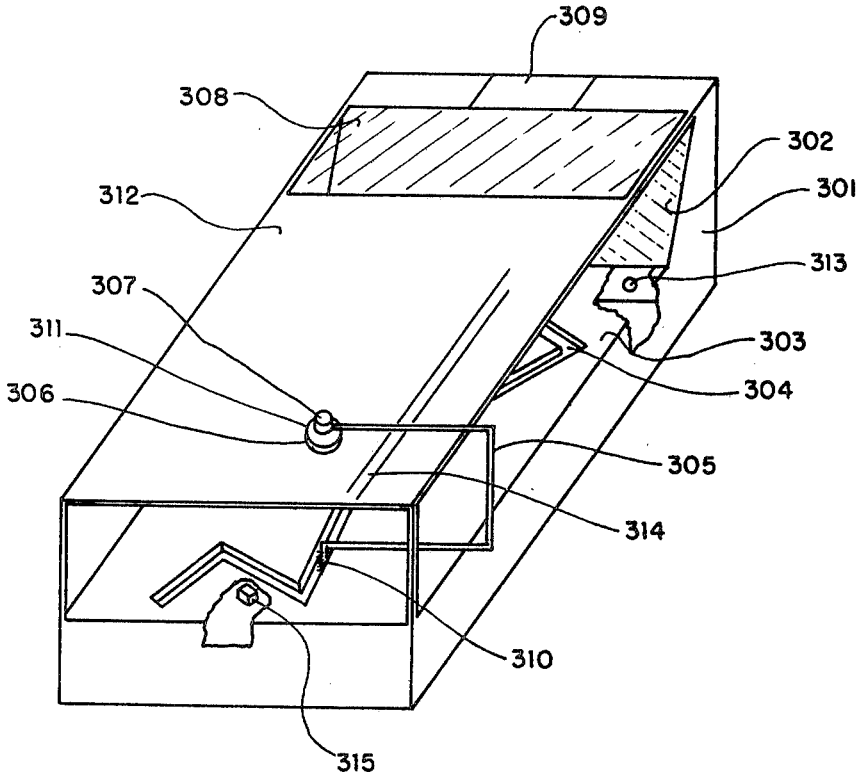
FIG. 3 is a pictorial view of a second embodiment of the invention.

FIG. 3 illustrates an alternative embodiment of the invention, comprising a housing 301, a mirror 302, a maze board 303, a maze path 304 within the maze board, a magnetically attractive cover 312, a viewing port 308, a display 309, a light source 313, and a wand 311. The wand comprises a handle 307, a magnet 306, a tip 310, and connecting means 305, which connects the magnet and handle with the tip.

The cover is supported by any suitable means, such as corner post in a position generally above and parallel to the maze board. The connecting means is a linkage between the handle and the tip of the wand which extends beyond the cover and then back beneath it to enable the tip to be inserted in the maze path and moved through the path by means of the handle. The magnet has a flat surface on its lower side which rests on and is attracted to the cover, thereby supporting the wand, and preventing it from tipping to one side as the wand is moved.

In the operation of the game, the wand is moved by the operator by means of the handle. The operator views the position of the wand tip in the maze path by way of the viewing port and mirror when the cover is opaque. The maze path may be viewed directly when the cover is transparent. Although the magnet is attracted to the cover, it can slide on the cover surface so that the wand may be moved as necessary to keep the tip in the maze path.

Figure 4:
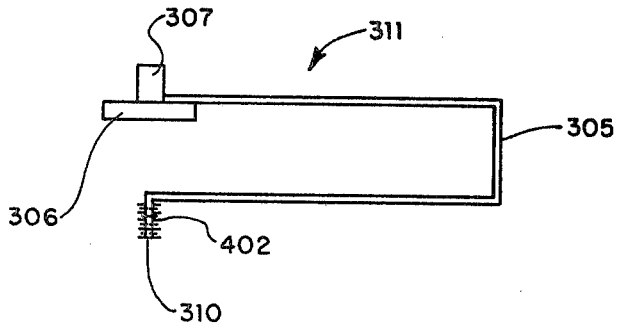
FIG. 4 is a side view of one embodiment of a wand.
Figure 5:
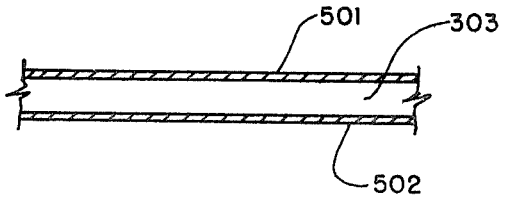
FIG. 5 is a side view of one side of the maze path of the type containing two conductors.

As can be seen in FIG. 4, the wand tip 310 may contain bristles 402 which are conductive. FIG. 5 shows a side of the maze board along the maze path. It comprises an upper conductor 501, the maze board 303 and a lower conductor 502. Whenever the bristles touch the side of the maze path, contact is made through the bristles and tip between the two conductors 501 and 502. This closes a circuit which actuates a display which may include an alarm that is located in the area designated by drawing numeral 309 in FIG. 3. The tip and conductor merely form a switch and act to turn on a display or alarm as described previously. The bristles insure contact with a conductor even where the conductor is slightly recessed from the path or the wand tip is not parallel to the path sides.

The tip may be made of magnetically attractive material. A magnetic obstruction in the maze path may be formed of a magnet, such as magnet 314, shown in FIG. 3, which is placed adjacent the maze path. As the operator brings the tip within the vicinity of the magnetic obstruction, the tip is drawn to the magnetic and if not well controlled by the operator, the tip will contact the side and actuate a display.

To assist in viewing the maze board, a light, such as light 313, is added. This light may be located above the maze board or below the maze board, as shown in FIG. 3. When located above the board, it lights the board in a conventional manner. When located below, light penetrates the board only through the maze path, highlighting the path.

The cover may be a polarized filter and two sources of light, similar to light source 313, may be supplied, one being diffuse and the other cross polarized with respect to the filter. Energizing only the cross polarized light source will tend to make the board invisible to the viewer except by way of the mirror, while diffuse light will make it directly visible through the cover, easing the complexity of the game. To maintain the magnetic attractiveness of the cover as well as its transparency, spaced apart, magnetically attractive wires, such as wire 314, may be placed in or beneath the cover.

An alternative method of providing a switch to actuate a display is to install a single conductor of either side of the maze path, similar to that described in connection with FIG. 2; however, these conductors are electrically connected together at some point away from the maze path and together form one contact of the switch. The second contact is formed by the wand and magnetically attractive surface combination, as shown in FIGS. 3 and 4. In the operation of this switch arrangement, current passes from a conductive magnetically attractive surface through the wand magnet, connecting means and tip to one of the maze path conductors which the probe has contacted to complete the switch circuit.

Figure 6:
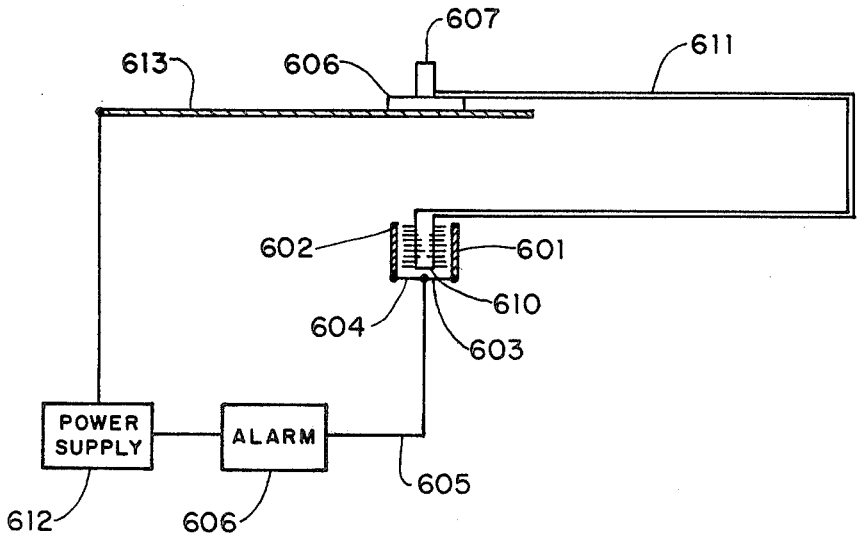
FIG. 6 is a diagram of an alternative system for actuating an alarm or display.

This alternative system for providing a switch to actuate a display is shown in FIG. 6. In this Figure, this system is shown comprising a magnetically attractive surface 613, a wand magnet 606 resting on and in electrical contact with the magnetically attractive surface, a wand handle 607 connected to the magnet, a wand tip 610, a means 611 for connecting the magnet with the tip, both mechanically and electrically, a right side of the maze path 601, and a left side of the maze path 602 with which the wand tip may make electrical contact, a lead 604 from the left side of the maze path and a lead 603 from the right side of the maze path which are joined electrically to one another, an alarm or display 606, a lead 605 which connects the joined leads 603 and 604 to the alarm 606, and a power supply 612 which is connected to the alarm and the magnetically attractive surface 613, to complete the series circuit.

In the operation of the system of FIG. 6, the wand tip may make contact to either side of the maze path to complete a series circuit in which current flows from the power supply through the magnetically attractive surface, the wand magnet, the wand connecting means, the wand tip, a maze path side, lead 603 or lead 604, lead 605, the alarm or display and finally back to the power supply.

Having described my invention, I claim:

1. A maze device comprising:

(a) a maze board, considered for reference as being held in the horizontal plane, said board having a maze path with two generally parallel, vertically oriented sides, (b) a magnetically attractive maze cover means separated from the top of the maze by being positioned above and generally parallel to said maze boards, said cover means including means to make said cover opaque, (c) a reflective surface means located at one end of the maze and positioned at an angle to permit viewing of the maze from above the cover when the cover is opaque, (d) a wand comprising a tip with a width which fits between the two sides of the maze path without touching either side, a magnetic base which rests upon the cover and is slideably held to the cover by means of magnetic attraction between the magnet and the cover, a handle connected to the upper side of the magnet, and connecting means connecting the magnetic base and handle to the tip of the wand, by way of extending beyond the cover on the upper side of the cover and then downward to clear the cover and then back beneath the cover to enable the tip to be moved along the maze path by moving the handle on the upper side of the cover, and (e) display means for indicating contact between the tip of the wand and a side of the maze path.

2. A device as claimed in claim 1, wherein the maze path cuts through the maze board and said device further comprising means for illuminating located beneath the maze board to illuminate only the maze path when the maze board is viewed from above.

3. A device as claimed in claim 1, wherein the cover is a polarized filter and said device includes means to selectively illuminate the maze path with diffuse light and light cross polarized with respect to the filter to make the cover appear transparent and opaque, in accordance with the type of illumination selected.

4. A device as claimed in claim 3, wherein the maze path cuts through the maze board, said means to selectively illuminate the path is located beneath the maze board and essentially illuminates only the maze path when viewed from above the maze board.

5. A device as claimed in claim 1, wherein the maze board is removable to permit replacement with boards having different maze paths.

6. A device as claimed in claim 1, wherein the wand tip is magnetically attractive and the maze board includes magnets placed along the side of the maze path to serve as magnetic obstructions to traversing the wand along the path without touching either side.

7. A device as claimed in claim 1, wherein said wand tip includes brush-like conductive bristles, the tip is conductive and the sides of the maze path contain two conductors to provide a conductive circuit from one conductor through the wand tip to the outer conductor when the wand tip contacts a side of the maze path, said conductive circuit acting as a switch to activate the display means.

8. A device as claimed in claim 1, wherein the wand tip, connecting means, magnet and magnetically attractive surface are conductive and in series form one portion of a conductive circuit to actuate the display, and wherein the maze device further comprises a conductor on each side of the maze path which are electrically connected together and which form a second portion of the conductive circuit to actuate the display, the wand tip completing the circuit to actuate the display when contacting one of the conductors on either side of the maze path.

* * * * *